United States Patent [19]

Chaussadas

[11] Patent Number: 4,784,266

[45] Date of Patent: Nov. 15, 1988

[54] MEANS FOR STABILIZING ARTICLES IN MULTIPLE ARTICLE PACKAGES

[75] Inventor: Jean Chaussadas, Deols, France

[73] Assignee: The Mead Corporation, Dayton, Ohio

[21] Appl. No.: 161,702

[22] Filed: Feb. 29, 1988

[30] Foreign Application Priority Data

Mar. 27, 1987 [GB] United Kingdom ..... 8707392

[51] Int. Cl.[4] ..... B65D 65/12

[52] U.S. Cl. ..... 206/434; 229/40; 206/139

[58] Field of Search ..... 229/40; 206/162, 429, 206/434, 139, 141

[56] References Cited

U.S. PATENT DOCUMENTS 4,029,204 6/1977 Mahizza ..... 206/434 X

FOREIGN PATENT DOCUMENTS 1485701 5/1967 France ..... 206/434

1564751 3/1969 France ..... 206/434

*Primary Examiner*—William Price

*Attorney, Agent, or Firm*—Erwin Doerr

[57] ABSTRACT

A package accommodating a plurality of bottles, the package being of the type having a top wall (12) and a bottom wall interconnected by spaced side walls (22, 24) thereby providing a tubular structure and end retention panels (**32, 32*a*) which partially close the ends of the tubular structure so as to assist in preventing endwise dislodgement of the bottles, stabilizing means (42, 42*a***) for better maintaining the bottles in spaced relationship and in a desired upright attitude. The spacing and stabilizing means comprising a top panel flap which is put into its operative position automatically upon folding of the end retention panels relative to the top panel into their end retention position.

6 Claims, 3 Drawing Sheets

MEANS FOR STABILIZING ARTICLES IN MULTIPLE ARTICLE PACKAGES

This invention relates to a multipack in which stabilizing means are provided for assisting in maintaining articles accommodated within the package, such as bottles, in their correct upright position. In some known wrap-around type carton sleeves, end retention panels are provided to assist in the prevention of dislodgment of the packaged articles endwise from the carton sleeve. Tall bottles are particularly susceptible to toppling and these end retention panels provide a convenient and cost-effective way of providing retention of the bottles at the open ends of the carton sleeves while also providing an additional printing surface for advertising purposes. In some multiple packages, particularly for tall bottles, it has been found that the bottles have a tendency to fall inwardly i.e. towards the centre of the bottle group.

The present invention seeks to avoid such bottle dislodgement by stabilizing means provided by a part of the package and which can be made effective during formation of the package with existing machinery.

One aspect of the invention provides a package accommodating a plurality of articles, such as bottles of the type having a top wall and a bottom wall interconnected by spaced side walls thereby providing a tubular structure and end panel retention means at least partially to close the ends of the tubular structure so as to assist in preventing endwise dislodgement of the articles, stabilizing means for better maintaining said articles in a desired upright attitude, characterised in that said stabilizing means is put into its operative position automatically upon folding of said end panel retention means into their end retention position.

According to a feature of this aspect of the invention, said stabilizing means may comprise a hinged panel portion of the package. Preferably, said stabilizing means comprises a flap formed partially from said top panel and partially from said end panel retention means and is hinged to said top panel and said end panel retention means so as to be displaced out of the plane of said top panel when the end panel retention means is folded into its end retaining position.

In constructions where this feature is adopted, said flap may include a line of weakness intermediate the fold lines by which it is hinged to said top panel and to said end panel retention means, said flap folding in a toggle action along said fold lines and said line of weakness when said end panel retention means is folded into its end retaining position.

Preferably, the end panel retention means comprises a main end panel portion hinged to said top panel and gusset panels hinged to said main end panel portion and to each of said respective side walls.

Another aspect of the invention provides a blank for forming a multiple article package which blank comprises a top panel, a side wall panel hinged to each of two opposite side edges of the top panel and a base panel hinged to each side wall panel remote from said top panel, end panel means hinged to each of two opposite end edges of the top panel and to respective ones of the side wall panels, characterised by displacable spacer flaps each formed partially in and hinged to said top panel and partially in and hinged to the adjacent end panel means, said displacable spacer flap being foldably intermediate its hinged connection to the top panel and to the adjacent end panel means so that the displacable spacer flap can be displaced out of the plane of the blank automatically upon folding of the end panel means relative to said top and side panels.

An embodiment of the invention will now be described, by way of example with reference to the accompanying drawings, in which.

Figure 1:
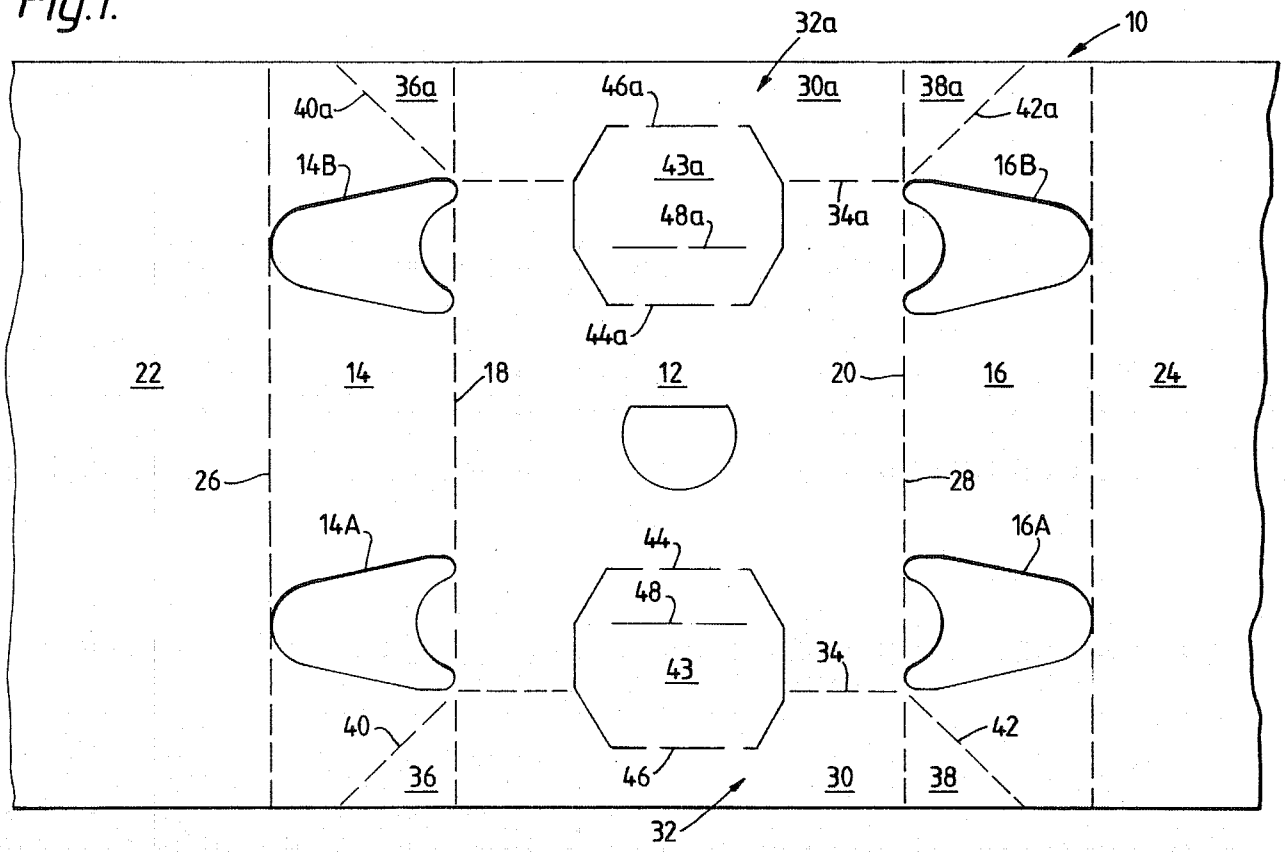
FIG. 1 is a plan view of a blank of a wrap-around type carton.

Referring to FIG. 1 of the drawings, a central portion of an elongate blank 10 formed from paperboard or similar foldable sheet material comprises a top panel 12 to the opposed transverse edges of which are hinged upper side wall panels 14 and 16 about transverse fold lines 18 and 20 respectively. The edges of the upper side wall panels remote from the top panel likewise are hinged to main side wall panels 22 and 24 about fold lines 26 and 28 respectively. The main side wall panels 22 and 24 are shown cut away in FIG. 1 and in order to form the wraparound carton shown in FIGS. 2 and 3 the blank further includes lower side wall panels in which bottle heel retaining apertures are formed and overlapping base panels as is well-known in the art.

Upper side wall panel 14 is formed with spaced bottle top receiving apertures 14A and 14B and likewise upper side wall panel 16 is formed with spaced bottle top receiving apertures 16A and 16B located in registry with apertures 14A and 14B.

Along each longitudinal edge of the blank 10, the top panel terminates in an end retaining panel, or 'ad-panel' as it is more usually called. Adjacent each longitudinal edge of the blank, the top panel is formed with a bottle neck spacer flap. The construction at each end of the top panel is similar and therefore like parts at one end of the top panel are designated like reference numerals to like parts at the opposite end with the addition of suffix 'a'.

The main portion 30 of end retaining panel 32 spans and constitutes one end of the top panel 12 and is hinged to an adjacent part thereof along longitudinal fold line 34. The end retaining panel 32 also includes gusset panel 36 and 38 provided by portions of the upper side wall panels 14 and 16 respectively. Gusset panel 36 is defined by an oblique fold line 40 extending from aperture 14A to the adjacent edge of the blank and the transverse fold line 18 by which the gusset panel 36 is hinged to the main portion 30 of end retaining panel 32. Gusset panel 38 likewise is defined between fold lines 42 and 20.

A bottle neck spacer flap 43 is struck from the blank partially in the top panel 12 and partially in the main portion 30 of the end retaining panel so that the flap 43 is hinged to those panels about hinge lines 44 and 46 respectively, but otherwise cut out from the blank.

Figure 2:
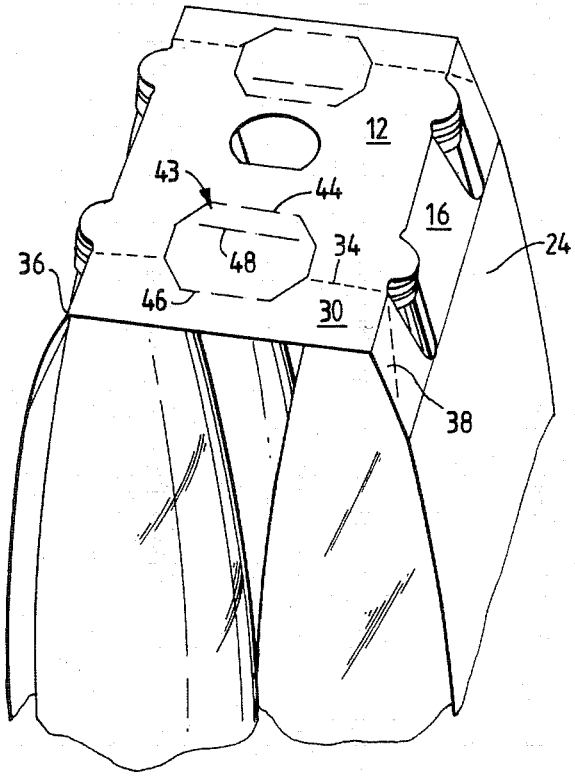
FIG. 2 is a perspective view of the carton seen from one end, showing the end retaining panel and bottle spacer flap prior to being folded into their operative positions.
Figure 3:
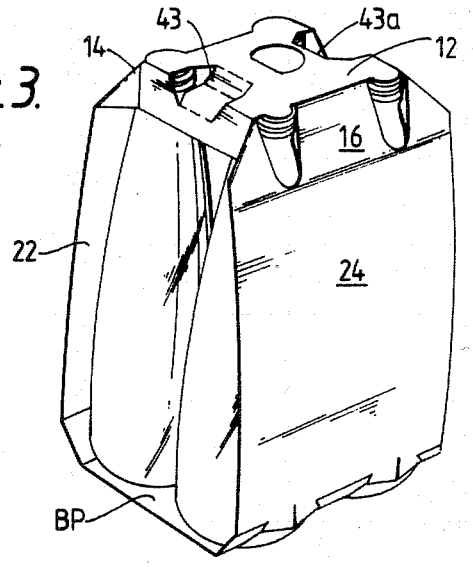
FIGS. 3 and 3*a* are perspective views of the carton seen from the side and one end, showing an end retaining panel and bottle spacer flap folded into its operative position.
Figure 3A:
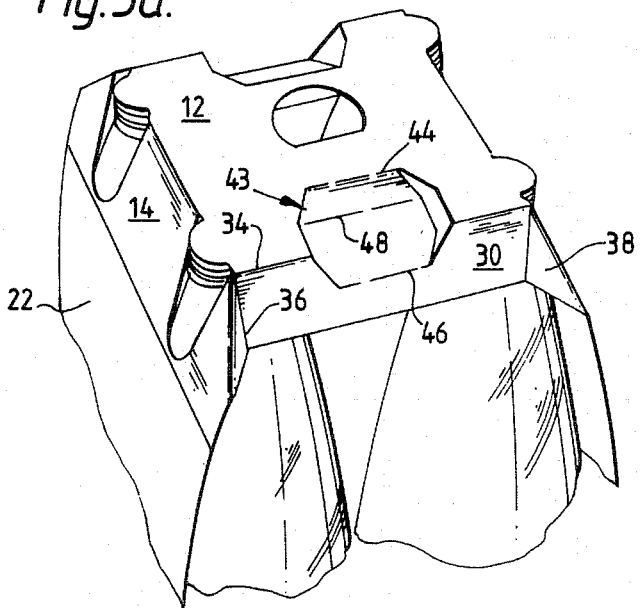

The blank is applied to a group of bottles, in this case arranged in two parallel rows of tow bottles per row by a known wrap-around and securing technique to arrive at the condition illustrated in FIG. 2. Thereafter, the end retaining panels 32 and **32*a* are folded downwardly at each end of the sleeve formed by the wrap-around folding. Each of the bottle neck spacer flaps are formed with a cut line 48, 48***a* intermediate and parallel to the fold lines 44 and 46 about which the flaps can fold in a toggle action. This action occurs automatically upon folding of the end retaining panels which brings the flaps into their operative position in which they are displaced out of the plane of the top panel inwardly of the carton. Thus, each flap folds about fold lines 44 and 46 and about cut line 48. Once displaced, each spacer flap is disposed between neck portions of the adjacent end most bottles within the package to assist in maintaining the bottles in their correct upright positions within the package and particularly to prevent the bottles toppling inwardly whereas the end retention panels prevent the bottles toppling endwise of the package.

I claim:

1. A package accommodating a plurality of articles, such as bottles of the type having a top panel and a bottom wall interconnected by spaced side walls thereby providing a tubular structure and end panel retention means at least partially to close the ends of the tubular structure so as to assist in preventing endwise dislodgement of the articles, stabilizing means for better maintaining said articles in a desired upright attitude, characterized in that said stabilizing means is put into its operative position automatically upon folding of said end panel retention means into their end retention position.

2. A package according to claim 1, further characterised in that said stabilizing means comprises a hinged panel portion of the package.

3. A package according to claim 2, further characterised in that said stabilizing means comprises a flap formed partially from said top panel and partially from said end panel retention means and is hinged to said top panel and said end panel retention means along fold lines so as to be displaced out of the plane of said top panel when the end panel retention means is folded into its end retaining position.

4. A package according to claim 3, further characterised in that said flap includes a line of weakness intermediate said fold lines by which it is hinged to said top panel and to said end panel retention means, said flap folding in a toggle action along said fold lines and said line of weakness when said end panel retention means is folded into its end retaining position.

5. A package according to claim 3, further characterised in that said end panel retention means comprises a main end panel portion hinged to said top panel and gusset panels hinged to said main end panel portion and to each of said respective side walls.

6. A blank for forming a multiple article package which blank comprises a top panel, a side wall panel hinged to each of two opposite side edges of the top panel and a base panel hinged to each side wall panel remote from said top panel, end panel means hinged to each of two opposite end edges of the top panel and to respective ones of the side wall panels, characterised by displacable spacer flaps, each formed partially in and hinged to said top panel and partially in and hinged to the adjacent end panel means, said displacable spacer flap being foldable intermediate its hinged connection to the top panel and to the adjacent end panel means so that the displacable spacer flap can be displaced out of the plane of the blank automatically upon folding of the end panel means relative to said top and side panels.

* * * * *